United States Patent [19]

Meester

[11] Patent Number: 4,953,712

[45] Date of Patent: Sep. 4, 1990

[54] GRADING ROLLS FOR AGRICULTURAL, HORTICULTURAL AND OTHER ARTICLES

[75] Inventor: Jacobus Meester, Andijk, Netherlands

[73] Assignee: TS AGRO Products IM-Export B.V., Hendrik-Ido-Ambacht, Netherlands

[21] Appl. No.: 321,963

[22] Filed: Mar. 10, 1989

[51] Int. Cl.[5] ..... B07B 13/04

[52] U.S. Cl. ..... 209/669; 198/663; 198/676; 209/673

[58] Field of Search ..... 209/667, 669, 671, 673; 198/625, 663, 676

[56] References Cited

U.S. PATENT DOCUMENTS

| | | | |
|---|---|---|---|
| 530,261 | 12/1894 | Distl et al. | 209/669 |
| 1,461,265 | 7/1923 | Bullard | 209/669 X |
| 1,766,340 | 6/1930 | Kendall | 209/669 X |
| 1,882,130 | 10/1932 | Fielder | 209/669 |

FOREIGN PATENT DOCUMENTS

| | | | |
|---|---|---|---|
| 285226 | 10/1988 | European Pat. Off. | 209/669 |
| 1051084 | 1/1954 | France | 209/669 |
| 374897 | 6/1952 | United Kingdom | 209/669 |

*Primary Examiner*—Donald T. Hajec
*Attorney, Agent, or Firm*—Bauer & Schaffer

[57] ABSTRACT

A grading roll is provided having parallel and circumferentially closed sinuous grooves on the roll surface. The grooves are spaced axially along the longitudinal cross-sectional direction of each groove varies twice in angle with the roll axis, i.e., from 90 degrees to a certain value smaller than 90 degrees and back to 90 degrees. The bottoms of the grooves are at a constant radial distance from the roll axis, while the cylinder surface portions between the grooves decrease in radial distance from the roll axis from a minimum at the 90 degree angle portion of the grooves to a minimum between these portions.

7 Claims, 3 Drawing Sheets

GRADING ROLLS FOR AGRICULTURAL, HORTICULTURAL AND OTHER ARTICLES

BACKGROUND OF THE INVENTION

The present invention relates to apparatus for grading agricultural, horticultural and other articles and particularly to improved grading rolls therefor.

Apparatus is known from applicant's prior disclosure, No. EP-A-0285226, wherein the articles, such as tulip bulbs, onions and the like are passed over a pair of parallel counter rotating rolls. Each roll is generally cylindrical and is provided on its periphery with a number of annular grooves, which are uniformly spaced in the axial direction along the length of the roll. Each roll is further provided with a flat or chordal portion extending longitudinally along its length so that the flat portion is closer to the central axis of the roll than the remaining surface of the cylinder. Additionally, guide strips, extending from the upper end of the flat portion downwards through the dimension of one or more of the axially spaced grooves, are provided.

The grading rolls are rotated counter to each other, with the flat portions arranged in opposition to each other such that the circumferential surfaces at the top of the rolls move away from each other, and the grooves form holes between the rolls. Thus articles, when placed on the rolls, are graded by the fact that correspondingly-sized articles fall through the holes formed between the grooves, while articles larger than the holes are carried forwardly along the axis of the cylinder by the guides. When the large articles reach the axial end of the grading rolls, they are transferred by the guiding strips onto a similar formed and arranged pair of grading rolls with larger holes.

It has appeared, in practice, that the known apparatus presents some danger in that articles may become trapped and thereby damaged, e.g. cracked, between the flattened surfaces of the rolls. This may happen, particularly if there are inaccuracies in the rotational velocity of the rolls, which has to be adapted to the slant angle of the guiding strips provided on the flat surfaces. Furthermore, the provision of the guiding strips on the rolls requires separate manufacturing of said strips and additional work in assembling the strips to the rolls.

It is an object of the present invention to provide grading rolls which are simpler and less expensive to construct.

It is a further objection of the present invention to provide grading rolls which are gentler and less damaging to the articles being graded.

Further objects and advantages of the present invention will be apparent from the following disclosure of the invention.

SUMMARY OF THE INVENTION

According to the present invention, a generally cylindrical grading roll is provided having a plurality of parallel and helically encircling closed sinuously directed grooves on the roll surface. The grooves are spaced axially along the longitudinal axis of the roll from one end to the other. The longitudinal cross-sectional direction of each groove varies twice in angle with the roll axis, i.e., from 90 degrees to a certain value smaller than 90 degrees and back to 90 degrees. The bottoms of the grooves are at a constant radial distance from the roll axis, while the cylinder surface portions between the grooves decrease in radial distance from the roll axis from a maximum at the 90 degree angle portion of the grooves to a minimum between these portions.

A pair of rolls are positioned parallel to each other with corresponding portions placed in mirror image, opposite to each other, so that when rotated with equal rotational velocity, they move away from each other at their tops. The cylindrical portions between the grooves, which have the decreasing radial distance from the roll axis, constitute guides for transfering those articles being graded from one groove to the next, if such articles do not pass below the rolls via the aperture formed by the facing grooves of the pair of rolls.

One or more sets or pairs of rolls are provided in axial continuation so that the size of the apertures or holes between the grooves are larger in each further pair of rolls, moving in the direction in which the articles are transported. The articles are transported axially by the walls of the groove portions which have decreased wall height and which connect the groove portions at a 90 degree angle to provide the grading holes. Thereby the guides are continuous with the remaining roll portions separating grooves and are integral with the roll. If the articles to be graded, e.g. tulip bulbs, are too large in size to pass through the apertures between the rolls, they are lifted from the groove on which they have been discharged by the curved portions of the grooves, which have decreased height, onto the cylindrical wall portions and passed to the next groove in the axial direction and finally onto a further pair of rolls situated next in the transport direction of the apparatus, until they, in fact, fall through a suitably sized hole.

A further advantage of the present invention lies in the fact that it is now possible to mold the rolls from synthetic material, i.e., thermoplastic or the like, by die-casting in a single operation, thereby reducing cost and complexity.

Full details of the present invention are set forth in the following description and illustrated in the accompanying drawing.

DESCRIPTION OF THE PREFERRED EMBODIMENTS

Figure 1:
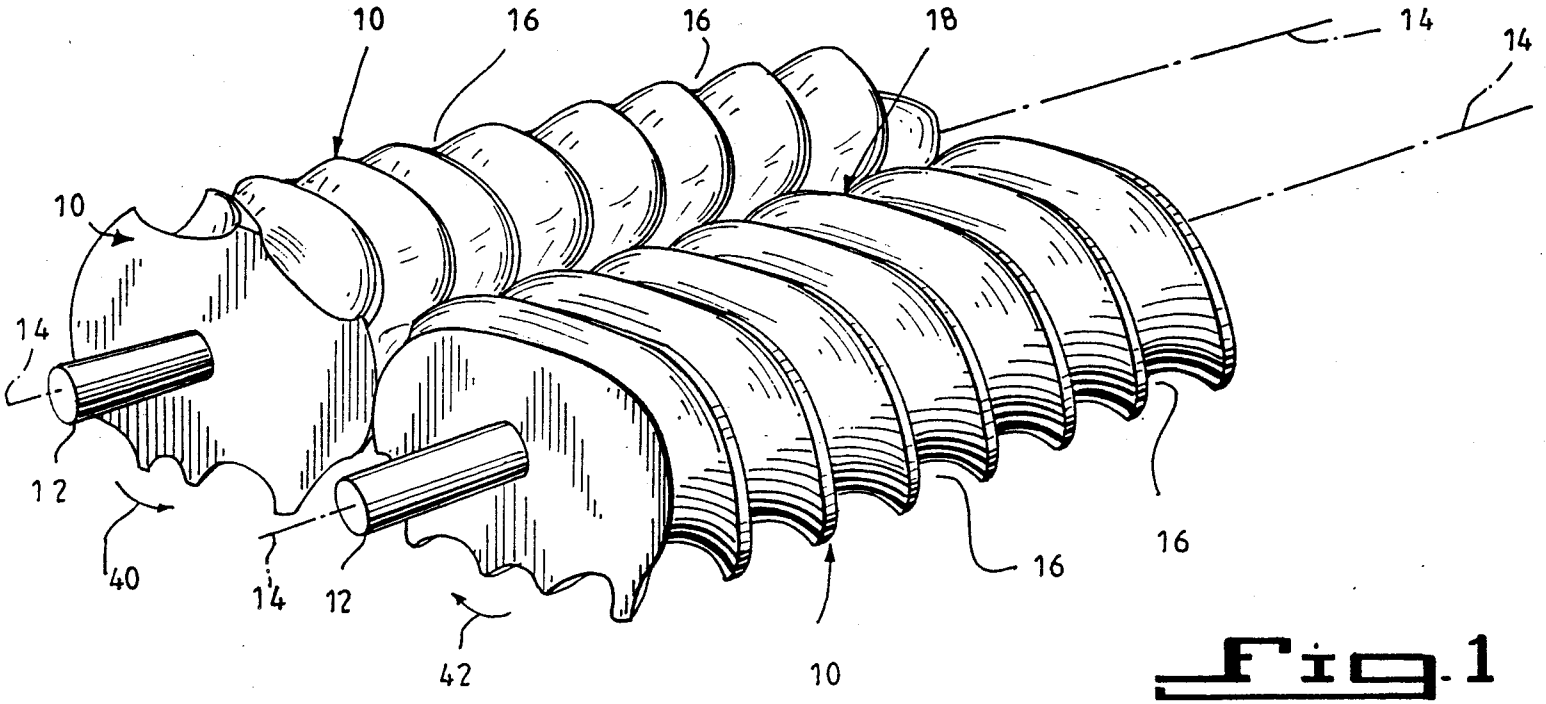
FIG. 1 is a perspective view of a pair of rolls according to the invention.

With reference to FIG. 1, a pair of cooperating grading rolls 10 are shown, mounted on parallel shafts 12 or stub shafts secured along the central axis 14 of the respective rolls. Each roll 10 is generally cylindrical but has formed in its cylindrical surface at least one set of a plurality of successive, parallel, generally sinuous grooves 16, spaced along the axis 14 of each roll and indicated by the letters a, b, c, and d, etc. Each groove 16 extends around the complete circumference of the cylinder in a helically encircling closed sinuous curve.

Both rolls 10 of each pair are formed mirror images of each other, and the rolls are placed parallel alongside each other, as shown in FIG. 1, so that grading apertures or holes 18 are formed by the opposing grooves 16, extending orthogonally to the plane containing both roll axes 12, through which articles to be graded, of a given size, may pass. Actually, both rolls may be identically formed and placed in opposite end to end directions to each other so as to provide the mirror image relationship.

Figure 2:
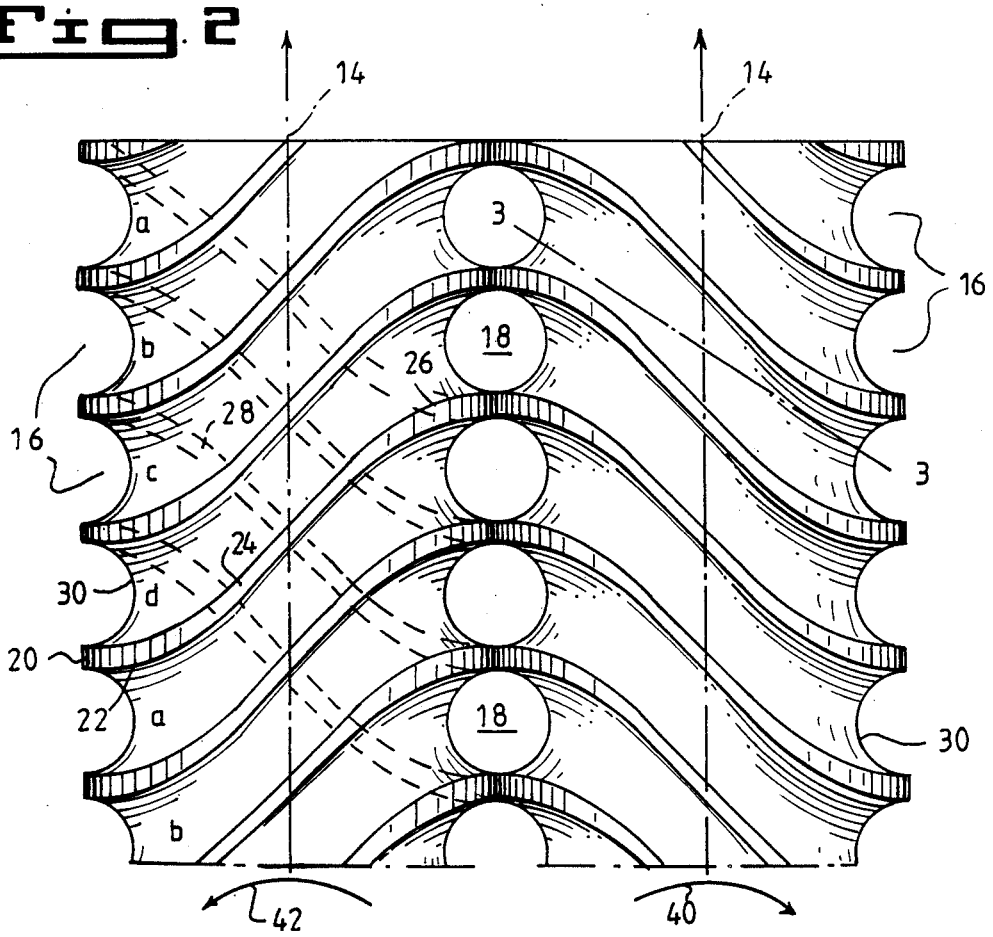
FIG. 2 is an enlarged plan view of an axial section of the rolls of FIG. 1.

The structure of the grading rolls 10 will be seen from FIG. 2 when considering for illustration the left roll 10. Each groove 16, in plan, has a sinuous surface 18 in a general transverse direction, defined by a perimetal ridge 20 between the grooves 16. The perimetal ridge 20 starts at the left side of the figure and extends with respect to the central axis to form a portion 22 at an angle of 90 degrees with the roll axis 14 a central portion 24 gradually decreasing in angle along the upper section of the groove to a certain value smaller than 90 degrees, for example 45 degrees, and from that point in a portion 26 having an angle that varies back to 90 degrees. From that point the groove 16 extends similarly at the underside of the roll, as indicated by the broken lines 28 indicated in FIG. 2, to form the helically encircling closed sinuous curve.

The grooves 16 have an arcuate cross section in a longitudinal plane passing through the central axis such that the groove bottoms 30 are at a constant radial distance from the axis 14. However, the perimetal ridge 20 on the surface of the roll varies in height relative to the central axis depending on the proximity of the sections of ridge to the specific portion of the groove (22, 24, 26, respectively). That is, the ridge section 20 adjacent the portion 22 of the groove, having the maximum angle to the central axis is highest, while the ridge section adjacent the bottom 30 of the groove having a minimum angle value with the central axis has the shallowest height. The intermediate section decrease and increase accordingly. In this manner, the ridges 20 undulate with respect to the central axis 14 with varying radius.

Figure 3:
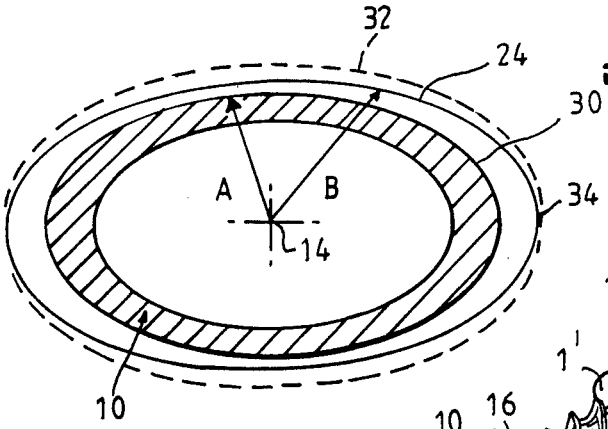
FIG. 3 is a sectional view of one roll taken along the line III—III of FIG. 2, which is oblique to the central axis of the roll.

This is more clearly illustrated in FIG. 3 in which the theoretical surface of the cylinders forming the roll is illustrated by the numeral 32, the highest edge or ridge portion 20 is indicated by the reference number 34. The radial distance of the groove bottom 30 is indicated by the radius A, and the radial distance of the decreased height section the ridge is indicated by the radius B.

The section of decreased height is obtained by removing material from the theoretical circumference 32. Of course, this material removal should not be taken literally because the described contour may also be obtained and is preferably obtained by molding the roll 10 directly into this shape.

The longitudinal transport of articles which cannot pass through the grading apertures 18 of the paired rolls 10 will be moved axially by braking against the defined groove edges of the ridges 20. These edges forming the edges of the groove on the surface, are worked as by rounding or skiving to provide a bevel so that the products will not be damaged by any sharp edge.

As shown in the afore-mentioned EPA application, the rolls of the cooperating pairs should be suitably mounted so that the shafts or stubs 12 are connected to a drive source to be rotated with equal rotational velocity, whereby the rolls rotate contra to each other upwardly as indicated by the arrows 40 and 42 in FIGS. 1 and 2. The rolls are preferably manufactured of any suitable material but are preferably molded by die-casting of a suitable synthetic material, e.g. polyvinylchloride or similar material.

Figure 4:
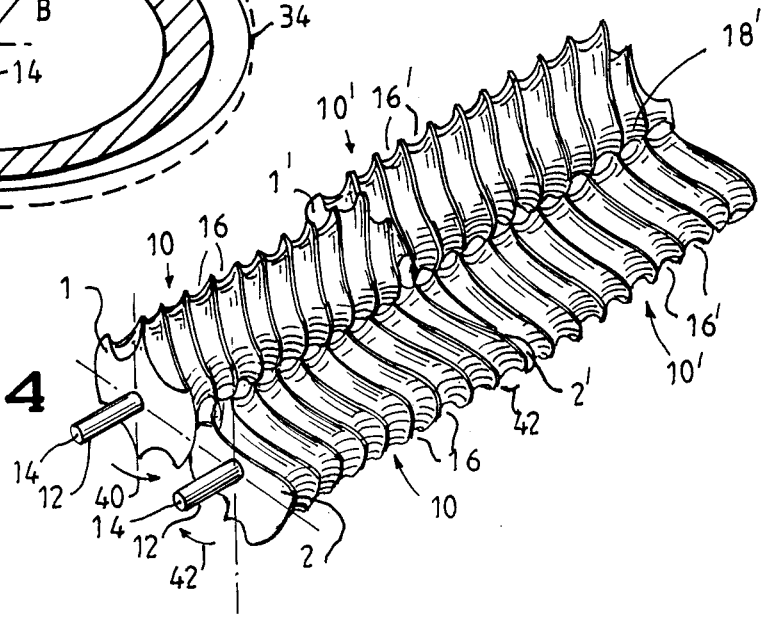
FIG. 4 is a view similar to FIG. 1, showing two pairs of rollers in tandem.

In a grading installation, a series of paired rolls are arranged axially with respect to each other so that each successive pair have larger holes. In FIG. 4 two pairs of rolls 10 and 10' are shown in tandem. Each of the rolls are identical in construction; those elements bearing the prime series are of larger size.

Various modifications, changes, and embodiments are set forth herein. Those skilled in this art will be aware of others. Therefore, it is intended that the present disclosure not limit the scope of the invention.

What is claimed is:

1. Grading apparatus for agricultural, horticultural, and other articles, comprising a pair of cooperating, parallel and horizontally arranged substantially cylindrical rolls, the surface of each of said rolls having a plurality of parallel and helically encircling closed sinuous grooves, said grooves being in succession and being spaced from each other along the axis of the roll, and having surface edge portions between adjacent grooves undulating in radial distance from the roll axis, said paired rolls being mirror images of each other, arranged side by side to be rotated with equal rotational velocity and with corresponding surface edge portions placed in facing opposition to each other such that the paired rolls move away from each other at their tops and form a series of apertures between the facing grooves for the passage of articles of equal or lesser size than said grooves, said surface edge portions between the grooves coating to provide for the transfer axially of the articles of greater size from one groove to the next.

2. The grading apparatus according to claim 1 wherein the direction of the curve of each groove varies twice in angle with the roll axis from 90 degrees to a value smaller than 90 degrees and back to 90 degrees, the bottoms of the grooves are at a constant radial distance from the roll axis and the surface edge portions between adjacent grooves decrease in radial distance from the roll axis from a maximum where the curve of the groove is at the 90 degree angle to a minimum therebetween.

3. The grading apparatus according to claim 2 including at least two, pairs of rolls arranged in axial continuation of each other, the size of the aperture of the grooves in each succeeding pair, being larger than in the preceding pair to pass articles of larger size.

4. The apparatus according to claim 2 in which the edges of the portions between adjacent grooves are rounded towards the groove walls to facilitate movement of articles thereover.

5. A grading roll for use in apparatus having at least one pair of rolls arranged parallel to each other and rotatable in opposite directions, the pair of rolls defining apertures between them for the passage therethrough of articles being graded, each said roll comprising an elongated cylinder having on its outer surface a plurality of parallel and helically encircling closed grooves spaced along the central axis, and each said roll further having surface edge portions between adjacent grooves, the curvature of each groove varying twice in angle with the cylindrical axis of the roll from a maximum of 90 degrees to a minimum therebetween, each said roll being shaped such that said surface edge portions constitute guides for axially transferring an article to be graded from one groove to the next.

6. The grading roll according to claim 5 wherein each said roll is shaped in such a manner that the surface edge portions vary in radial distance from the central axis of the roll.

7. The apparatus according to claim 6 in which the surface edge portions are rounded towards the groove walls to facilitate movement of articles thereover.

* * * * *